US005228590A

United States Patent [19]

Blasko et al.

[11] Patent Number: 5,228,590

[45] Date of Patent: Jul. 20, 1993

[54] CARTON FOR STORING AND DISPENSING SUBSTANTIALLY CYLINDRICAL ARTICLES

[76] Inventors: John Blasko, 7270 Sandtree La., Mentor, Ohio 44060; Mark Longo, 803 Meadowview La., Gates Mills, Ohio 44040

[21] Appl. No.: 752,823

[22] Filed: Aug. 30, 1991

[51] Int. Cl.[5] ..... B65D 85/00

[52] U.S. Cl. ..... 220/501; 220/23.4; 206/44.12; 206/504; 206/44.11; 222/185; 312/60

[58] Field of Search ..... 206/44 R, 44.11, 44.12, 206/557, 563, 564, 504, 508; 229/10, 11, 20, 122.1; 220/501, 503, 575, 505, 23.4; 312/42, 45, 60, 118, 121; 221/133, 185, 281; 222/185

[56] References Cited

U.S. PATENT DOCUMENTS

| | | | |
|---|---|---|---|
| 1,378,534 | 5/1921 | Gerald | 229/122.1 |
| 1,645,771 | 10/1927 | Pillsbury | 229/122.1 |
| 1,898,056 | 2/1933 | Johnson | 206/44.12 |
| 2,112,959 | 4/1938 | Harvey | 206/44.12 |
| 2,207,417 | 7/1940 | Smith | 220/575 |
| 2,582,207 | 1/1952 | Shaw | 222/185 |
| 2,785,843 | 3/1957 | Shaw | 206/44.12 |
| 2,852,327 | 9/1958 | Mason . | |
| 2,922,552 | 1/1960 | Berger et al. | 222/185 |
| 2,996,344 | 8/1961 | Garman . | |
| 3,157,445 | 11/1964 | Aversa | 312/45 |
| 3,164,298 | 1/1965 | Repko . | |
| 3,208,583 | 9/1965 | Kamps | 206/45.14 |
| 3,224,822 | 12/1965 | Kirby | 220/339 |
| 3,286,846 | 11/1966 | Brandes . | |
| 3,307,729 | 3/1967 | Schwartz | 206/504 |
| 3,318,455 | 5/1967 | Takahashi . | |
| 3,375,057 | 3/1968 | Morris | 220/501 |
| 3,568,911 | 3/1971 | Bebout | 229/122.1 |
| 3,635,350 | 1/1972 | Wolf | 206/504 |
| 3,805,964 | 4/1974 | Titus, Jr. . | |
| 3,861,433 | 1/1975 | Schier et al. | 206/508 |
| 3,927,809 | 12/1975 | Klein, Sr. | 312/42 |
| 3,990,752 | 11/1976 | Hoffman et al. | 206/459 |
| 4,043,485 | 8/1977 | Tippetts | 312/60 |
| 4,069,940 | 1/1978 | Naimoli | 220/575 |
| 4,195,744 | 4/1980 | Christianson | 220/1.5 |
| 4,228,903 | 10/1980 | Eckert . | |
| 4,305,628 | 12/1981 | Glasener | 206/44.12 |
| 4,386,710 | 6/1983 | Dauman . | |
| 4,401,255 | 8/1983 | Conroy et al. | 229/162 |
| 4,530,548 | 7/1985 | Spamer et al. | 229/122.1 |
| 4,538,726 | 9/1985 | Pastva | 206/44.12 |
| 4,574,981 | 3/1986 | Jewett . | |
| 4,605,128 | 8/1986 | Rieke | 229/40 |
| 4,676,371 | 6/1987 | Byrne | 206/44.12 |
| 4,732,282 | 3/1988 | Lockwood . | |
| 4,742,936 | 5/1988 | Rein . | |
| 4,747,510 | 5/1988 | Mack | 206/508 |
| 4,763,963 | 8/1988 | Lauffer et al. . | |
| 4,998,628 | 3/1991 | Ross . | |
| 5,020,719 | 6/1991 | Roth et al. | 229/122.1 |
| 5,044,501 | 9/1991 | Shaker et al. | 312/60 |

FOREIGN PATENT DOCUMENTS

| | | | |
|---|---|---|---|
| 1057262 | 3/1954 | France | 229/122.1 |
| 495649 | 6/1954 | Italy | 312/121 |

*Primary Examiner*—David T. Fidei

*Attorney, Agent, or Firm*—McAndrews, Held & Malloy, Ltd.

[57] ABSTRACT

The present invention is directed to a carton for storing, dispensing, and displaying adhesives, caulks, sealants, and other articles in tube form. The carton has two apertures, an upper aperture and a lower aperture. The upper aperture is used for loading the articles into the carton. The lower aperture opens into a trough into which the articles are dispensed and displayed. The bottom wall of the carton is inclined causing the articles stored therein to roll towards the lower aperture and be dispensed into a trough. The carton uses a trough notch to allow easy removal of the articles from the trough. Preferably, the carton has a notch in the lower portion of the front wall to allow easy access to the articles to be dispensed in order to free jammed or otherwise displaced articles. The carton also preferably has correspondingly positioned holes in the top, bottom, and side walls for receipt of a fastener means such that a series of two or more cartons may be securely affixed side by side. The top wall and bottom wall provide an interlocking feature when two cartons of the present invention are vertically stacked.

14 Claims, 1 Drawing Sheet

CARTON FOR STORING AND DISPENSING SUBSTANTIALLY CYLINDRICAL ARTICLES

BACKGROUND OF THE INVENTION

1. Field of Invention

This invention relates to an apparatus for storing, dispensing, and displaying substantially cylindrical articles. More particularly, the present invention is directed to a gravity fed carton for storing, dispensing, and displaying adhesives, caulks, sealants and other articles in substantially cylindrical tubes. The carton of the present invention requires no internal shelf that would otherwise occupy storage space. Moreover, when used in a grouping, the cartons are uniform in appearance whether full or containing only a single item. The carton of the present invention is useful, particularly in a retail establishment, because it maximizes the internal storage of goods and uniformly displays the goods independently of the amount of goods in the carton.

2. Prior Art

A problem facing all retailers is how to make shelves look full even when they are not. Full shelves give the impression to the consumer that the retailer will always have a supply of the goods they have come to expect. To create the impression that the shelves are full, retailers often stack goods at the front of the shelf, leaving the rear empty. Although the stacked wall of goods creates a first impression that the shelves are full, the solution is not wholly satisfactory. When the consumer removes one of the stacked items from the wall of goods, the void of space that lies behind the wall becomes visible. An object of the present invention is to provide a carton for use on a retail shelf that displays the goods to the consumer and that creates the impression of a full shelf when at least one item remains.

The prior art includes dispensers for storing and dispensing cylindrical articles and cans, such as for dispensing soft drinks in a soft drink machine or refrigerated cooler. These dispensers typically use at least one internal shelf which defines a path to guide the cylindrical articles to an opening near the bottom of the carton.

A problem in the prior-art dispensers is that the internal shelf occupies space useful for storing the articles to be dispensed. For example, U.S. Pat. Nos. 2,996,344, 2,852,327, 3,805,964, and 4,998,628 each teach a can dispenser having an internal shelf that is inclined downward, along which the cans move from the front to the rear of the dispenser. The shelf necessarily requires space that would otherwise be useful for the storage of articles to be dispensed. Similarly, U.S. Pat. No. 4,763,963 teaches a storage-rack assembly wherein bottles and cans are stored and dispensed by way of a serpentine storage column. It is an object of the present invention to maximize storage space within a storage dispenser by dispensing articles without the use of an internal shelf or serpentine storage column.

A further problem with the prior art is that the internal shelves cannot be easily molded by conventional injection molding processes.

An object of the invention is to provide a carton that may be easily molded by injection molding without the inherent difficulties of molding an internal shelf. Another object of the present invention is to provide a display dispenser carton that is capable of being easily loaded with the articles to be dispensed and that allows for the easy clearance of jammed or otherwise displaced articles.

Another object of the present invention is to provide a dispenser display carton that is capable of being laterally or horizontally affixed to one or more other display dispenser cartons, either vertically, horizontally, or both.

Further objects of the present invention will be apparent from the detailed description of the invention.

SUMMARY OF THE INVENTION

The present invention comprises a carton for storing and for dispensing, via gravity, substantially cylindrical articles without the use of an internal shelf. The carton of the present invention includes both an upper aperture for inserting into the carton the articles to be dispensed and a lower aperture near the bottom for dispensing such articles. The carton also includes a bottom wall that is inclined, in whole or in part, toward a front wall causing the cylindrical articles contained therein to roll forward through the aperture below the front wall (lower aperture) into a receiving trough. The trough stops the forward roll of the dispensed cylindrical item and displays the item to consumers for purchase. The front wall of the carton is preferably notched along its bottom edge to allow easy access to the articles to be dispensed to free jammed or otherwise displaced articles in the carton. The trough preferably has a centrally positioned trough notch that allows for the easy grasping of the dispensed and displayed articles. The height of the trough is preferably less than the diameter of any dispensed cylindrical item whereby the dispensed cylindrical item is at least partially visible in the trough even when viewed at eye level.

The carton preferably has correspondingly positioned means in its opposing side walls that allow for two cartons to be connected side by side. The carton preferably also has correspondingly positioned means in its top wall and bottom wall for securely stacking two cartons on top of one another.

DETAILED DESCRIPTION OF THE INVENTION

The present invention is directed to an apparatus for storing, dispensing, and displaying substantially cylindrical articles. In the present invention, the preferred cylindrical articles are tubes of caulks, sealants, adhesives, cleansers and other objects packaged in substantially cylindrical form. It is also within the scope of the present invention to encompass other articles packaged in substantially cylindrical tubes, such as tools, caulking guns, screwdrivers, chisels, and the like.

In the following description, spatial orienting terms such as rear, front, top, and bottom are used to describe the illustrated embodiment of the invention.

Figure 1:
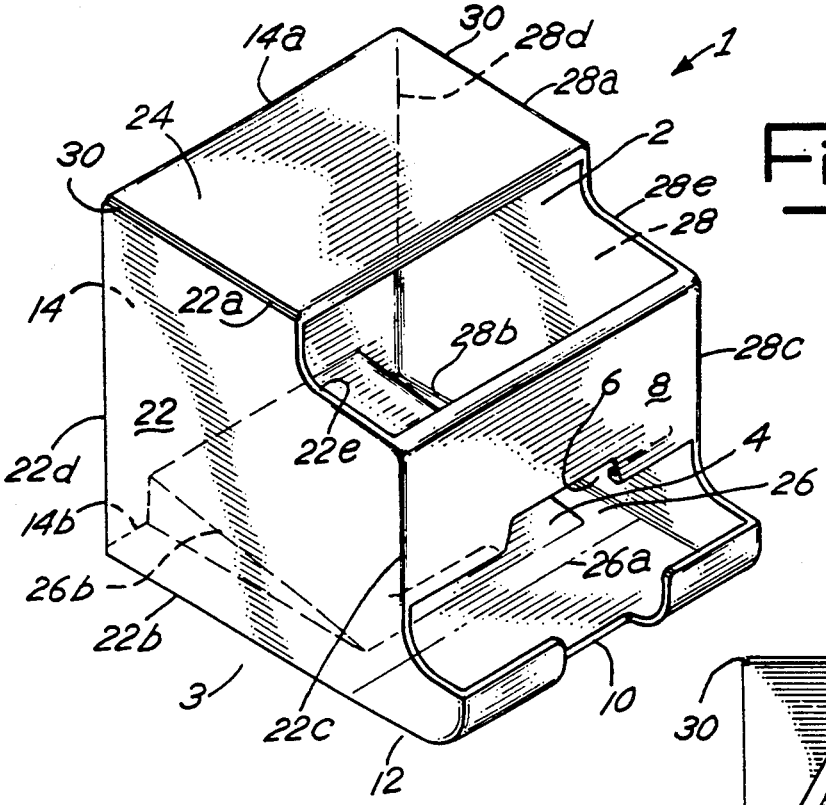
FIG. 1 is a perspective view of the carton of the present invention.

FIG. 1 is a perspective view of one embodiment of a carton 1 of the present invention. FIG. 1 shows a carton for storing, dispensing, and displaying substantially cylindrical articles, such as on a retail shelf. In FIG. 1, the carton comprises a box 3 and a trough 12. The box 3 comprises a first sidewall 22, a second side wall 28, a top wall 24, a bottom wall 26, a rear wall 14, and a front wall 8. The articles are inserted in an upper aperture 2 and are dispensed through a lower aperture 4. The front wall 8 optionally provides a display surface upon which merchandising or other information may be affixed. A notch 6 in the front wall 8 allows for easy access to the articles to be dispensed in order to free jammed or otherwise displaced articles in the carton. A trough notch 10 in the trough 12 makes it easier to grasp the displayed article that has been dispensed into the trough.

In FIG. 1, vertically positioned rear wall 14 is of a predetermined horizontal length that is longer than the length of the articles to be dispensed from the carton.

The first side wall 22 and the second side wall 28 each have respectively an upper edge (designated edges 22*a* and 28*a*), a lower edge (designated edges 22*b* and 28*b*), a front edge (designated edges 22*c* and 28*c*), and a back edge (designated edges 22*d* and between the upper edge and front edge of the side wall and defined by cut-out edge 22*e* and 28*e*, respectively. First side wall 22 is connected to the rear wall 14 at edge 22*d*. Second side wall 28 is connected to the rear wall at edge 28*d*.

Top wall 24 is connected to the first side wall at edge 22*a* and is connected to the second side wall 28 at edge 28*a*. Top wall 24 is also connected to the rear wall forming an edge 14*a*.

Bottom wall 26 is connected to rear wall 14 forming an edge 14*b*. Bottom wall 26 is also connected to the first side wall 22 and to the second side wall 28 at edges 22*b* and 28*b*, respectively. An incline is associated with the bottom wall that is capable of gravitationally dispensing cylindrical articles stored in the box out the lower aperture. A portion of the bottom wall 26 itself may be affixed to the side walls and back wall to form an incline (not shown). Preferably, the bottom wall 26 has an integrally molded incline 26*b* built into it. The incline 26*b* is directed downward towards a fourth edge of the bottom wall, designated 26*a*.

Front wall 8 is parallel to rear wall 14 and has a height (as measured in the vertical direction) that is substantially shorter than the height of the rear wall (as measured in the vertical direction). The front wall is connected to the first side wall 22 at edge 22*c* below the cut-out 22*e*. The front wall 8 is also connected to the second side wall 28 at edge 28*c* below the cut-out 28*e*. This forms an upper aperture 2 between the top wall 24 and the front wall 8. A lower aperture 4 is also formed between the front wall 8 and the bottom wall 26. The lower aperture 4 and the upper aperture 2 are each of sufficient size so as to allow the substantially cylindrical articles to be dispensed from the carton 1 and to be introduced into the carton through the apertures 4 and 2, respectively.

A trough 12 receives and displays the articles dispensed from the box 3. The trough 12 is connected to the bottom wall at edge 26*a*. The trough is also connected to the first and second side walls at the lower portion of edges 22*c* and 28*c*, respectively. Preferably, the trough 12 is integrally connected to the box 3.

Figure 2:
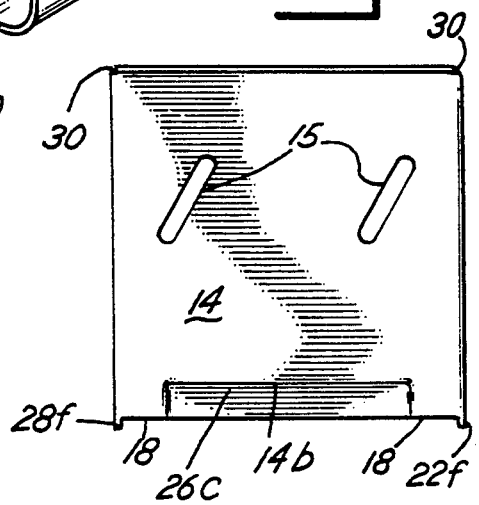
FIG. 2 is a perspective view of the rear wall of the carton of the present invention.

FIG. 2 is a perspective view of the rear of a carton of the present invention. The center portion of the bottom wall 26 connects the rear wall 14 at edge 14*b*. When the bottom wall 26 (not shown) has an integrally molded incline 26*b* built into it, the incline connects the rear wall at edge 14*b*, and the carton 1 stands on two segments 18 and a third segment 11 (not shown). Preferably, slots 15 are provided which allow the carton 1 to be affixed to a substantially vertical surface by means such as straps, hook-like projections, nails, screws, and the like.

Figure 3:
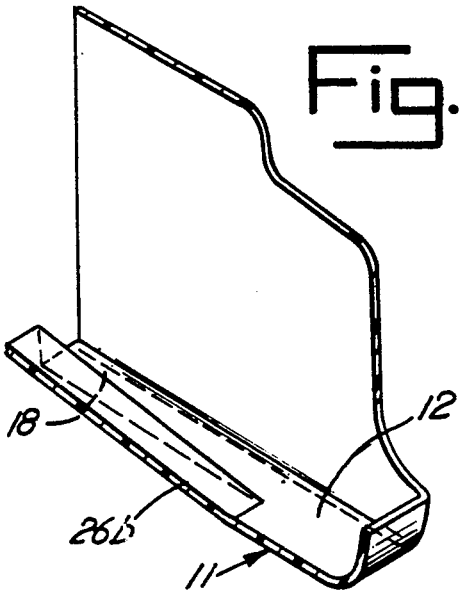
FIG. 3 is a partial sectional view of the carton of the present invention.

FIG. 3 is a partial sectional view of the carton 1 of the present invention. FIG. 3 shows the incline 26*b* which causes the cylindrical articles contained within the box portion of the carton to roll under the force of gravity toward the dispensing and display trough 12. It is preferable to incline only the center portion of the bottom wall 26. This forms a first segment 11 and two segments 18 (only 1 shown) upon which the bottom wall stands.

Figure 4:
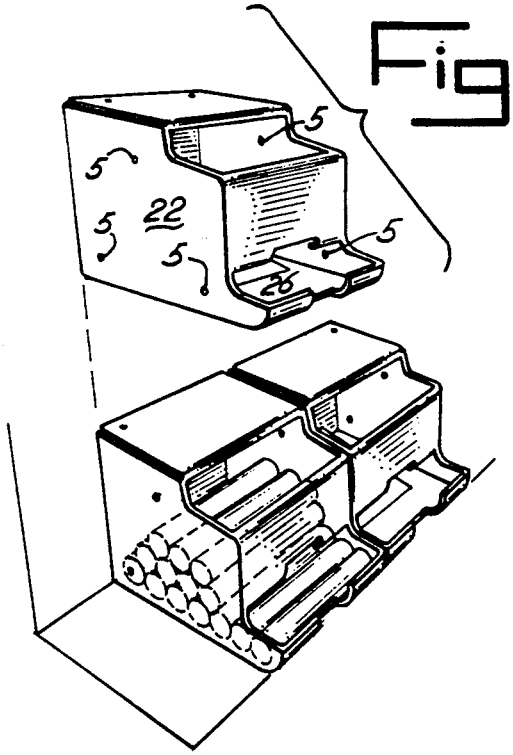
FIG. 4 is a perspective view of a plurality of cartons of the present invention illustrating how the cartons may be affixed to one another.

FIG. 4 is a perspective view of a plurality of cartons of the present invention that illustrates one means for affixing the plurality of cartons to one another in the vertical or horizontal position or both. In FIG. 4, the opposing side walls 22 and 28, respectively, are equal in length. The opposing side walls 22 and 28 of each carton 1 have correspondingly positioned holes 30 such that when two cartons of the invention are positioned side by side, the hole 30 in the side wall of the first carton overlap the hole 30 in the opposing side wall of the adjacent carton Each side wall may contain more than 1 hole 30. The opposing holes 30 are of sufficient size to accommodate a means for fastening the adjacent cartons to one another.

The means for fastening the cartons to one another is not a part of the present invention. Hence, any means for fastening the cartons together may be used. By way of example, the means for fastening the cartons to one another include nut and bolt combinations, rivets, rivet-screw combinations, clips, sheet metal screws, and the like.

The top wall 24 and the bottom wall 26 each have correspondingly positioned holes 30 such that when stacked, the cartons may be fastened to each other by one or more means for fastening. The means for vertically fastening the stacked cartons is not a part of the present invention and includes one or more means for laterally fastening, including those means mentioned above.

To facilitate stacking, the top wall of one carton preferably mates or interlocks with the bottom wall of the carton above it. By way of example and not limitation, such mating or interlocking may be accomplished via pins and correspondingly positioned holes, or a track and a rail, or a mortise and tenon. The carton of FIG. 1–4 perferably employs a modified tracks 30 and rails 28(*f*) and 22(*f*) to achieve interlocking wherein the top wall 24 projects slightly higher than the upper edges 22*a* and 28*a* of the side walls. Also preferably, at least a portion of the lower edges 22*b* and 28*b* of the side walls project downward beyond the bottom wall 26 so as to provide a rail 22*f* and 28*f* capable of mating or interlocking with the top wall of another carton of the present invention when vertically stacked. This interlocking feature stabilizes the stacked cartons and properly aligns a vertical stack of a plurality of cartons of the present invention. In this embodiment, which is not shown, the carton stands on rails 22*f* and 28*f*.

The front wall 8, the top wall 24, and the remaining portions of the carton are preferably plastic and may be molded separately by conventional molding processes such as rotational or injection molding. Molds constructed from P20 steel have been successfully used.

The rotational molding process has been used to make a one-piece carton, but for high volume production, the cartons are preferably made with the use of injection molds. When using injection molding, three separate molds have been utilized, one each for the front wall (i.e., "front wall mold"), the top wall (i.e., "the top wall mold"), and the remaining portion of the carton (i.e., "partial carton mold"). The "front wall mold" and the "top wall mold" appear to be best constructed with a 350–500 ton press, and the "partial carton mold" appears to be best constructed with a 850–1000 ton press.

When the front wall is formed by injection molding, it preferably has a dovetail running the length of each of its two outside edges. The dovetails slide into corresponding positioned dovetail slots that are in the carton to form a dovetail joint between the front wall and the carton. The dovetails are preferably at a 45° angle to the plane of the front wall from which they extend.

When the top wall is formed by injection molding, it preferably has dovetails for connecting to correspondingly positioned dovetail slots in each of the two side walls. The dovetails may be formed during the injection molding wherein the fan of the dovetail is within the plane of the top wall. More preferably, along each of two opposing sides of the top wall, there are from two to five dovetail shaped pins having flat ends wherein the shank of the pins are inserted into correspondingly positioned reinforced slots that open upwardly in each of the side walls. Most preferably, there are three of such pins along each of the two opposite edges of the top wall for interlocking with the corresponding slots provided in the first and second side walls so that the top wall may rest upon the side walls and be substantially perpendicular thereto.

Regardless of which of the above-described methods of molding the carton are used, the trough is integrally connected with the side walls 22 and 28 and the bottom wall 26.

The carton may be constructed with metal, wood, or any sufficiently sturdy plastic. A preferred plastic is a high-density polyethylene (HDPE), such as sold by Dow Chemical, Midland, Mich. Based upon the strength of the materials that are used for producing the carton, it may be necessary to add ribbing to one or more of the walls for increased strength, particularly if stacking is contemplated.

What is claimed is:

1. A stackable carton for storing, dispensing, and displaying substantially cylindrical articles of a predetermined length comprising:

a rear wall of a predetermined length that is longer than the predetermined length of the articles to be dispensed from the carton;

a first side wall and a second side wall, each of the side walls parallel to the other side wall and each having an upper edge (22*a* and 28*a*), a lower edge (22*b* and 28*b*), a front edge (22*c* and 28*c*), and a back edge (22*d* and 28*d*), each of the side walls having a cut-out located between the upper edge and the front edge of each side wall, the first side wall connected to the rear wall at the back edge (22*d*) and the second side wall connected to the rear wall at the back edge (28*d*);

a top wall connected to the first side wall and to the second side wall at their respective upper edges (22*a* and 28*a*), respectively, the top wall also connected to the rear wall forming a back edge of the top wall (14*a*), wherein the top wall has a length that does not cover any portions of the cut-outs of the first and second walls;

a bottom wall having a back edge (14*b*) and a front edge (26*a*), the bottom wall connected to the rear wall at the back edge of the bottom wall (14*b*) and connected to the lower edges of the first side wall and second side wall (22*b* and 28*b*), respectively;

a front wall parallel to the rear wall and having a height substantially shorter than the height of the rear wall, the front wall connected to the first side wall at the front edge of the first side wall (22*c*) below the cut-out (22*e*), the front wall also connected to the second side wall at the front edge of the second side wall (28*c*) below the cut-out (28*e*), forming an upper aperture between the front wall and the top wall and forming a lower aperture between the front wall and the bottom wall, the lower aperture and the upper aperture each being sufficiently large so as to allow articles to be placed into said carton through the upper aperture and to be removed from said carton through the lower aperture;

an incline associated with the bottom wall that is capable of gravitationally dispensing the cylindrical articles towards the lower aperture;

a trough for receiving the articles to be dispensed from the carton, the trough having a trough notch and the trough connected to the bottom wall at edge (26*a*) and to the first and second side walls at their front edges (22*c* and 28*c*), respectively, and whereby the substantially cylindrical articles are capable of being placed in the carton through the upper aperture when said stackable carton is in the stacked position.

2. The carton of claim 1 comprising in addition a notch in the front wall.

3. The carton of claim 1 wherein the top wall projects above the upper edges of the side walls, and the lower edges of the side walls projects downward beyond the bottom wall, whereby the top wall and bottom wall of said carton are capable of interlocking respectively with the bottom wall of a first identical carton correspondingly positioned above it and the top wall of a second identical carton correspondingly positioned below it.

4. The carton of claim 1 wherein the first side wall and the second side wall each have correspondingly positioned holes.

5. The carton of claim 1 wherein the top wall and the bottom wall each have correspondingly positioned holes.

6. The carton of claim 1 wherein the rear wall has a slot.

7. The carton of claim 1 wherein said cylindrical article is a container for an item selected from the group consisting of adhesives, caulks, and sealants.

8. The carton of claim of 1 comprising in addition a means for affixing to a second carton to form a lateral array.

9. The carton of claim 1 comprising in addition a means for affixing it to a second carton to form a vertical array.

10. The carton of claim 1 wherein the carton stands on a plurality of segments.

11. The carton of claim 1 wherein the trough is integral with said side walls and said bottom wall.

12. An interlockable carton for storing, dispensing, and displaying substantially cylindrical articles of a predetermined length comprising:

a hollow box having a first side wall, a second side wall, a top wall, a bottom wall, a rear wall, a front wall and two interlocking pairs;

an upper aperture in the box between the top wall and the front wall;

a lower aperture in the box between the bottom wall and the front wall;

an incline associated with the bottom wall that is capable of gravitationally dispensing the cylindrical articles stored in said box out of the lower aperture;

a trough having a trough notch, the trough connected to the lower aperture that is capable of both receiving the articles that are dispensed and of displaying them; and a member of each of said two interlocking pairs being positioned on said top wall, the corresponding member of each of said two interlocking pairs being positioned on said bottom walls in receiving relationship tô said interlocking pair members on said top wall, whereby the top wall of said carton is capable of interlocking respectively with the bottom wall of a first identical carton correspondingly positioned above it and the bottom wall of said carton is capable of interlocking with the top wall of a second identical carton correspondingly positioned below it.

13. The interlockable carton of claim 12 wherein said interlocking pair is a track and a rail.

14. The interlockable carton of claim 13 wherein said rail is positioned on the bottom wall and said track is positioned on the top wall.

* * * * *